United States Patent [19]

Aida et al.

[11] Patent Number: 4,774,900

[45] Date of Patent: Oct. 4, 1988

[54] APPARATUS FOR BACKTACKING THREAD CHAIN FOR USE WITH A TWO-NEEDLE OVEREDGE SEWING MACHINE

[75] Inventors: Kikuo Aida; Shingo Iwae, both of Chofu, Japan

[73] Assignee: Tokyo Juki Industrial Co., Ltd., Tokyo, Japan

[21] Appl. No.: 878,000

[22] Filed: Jun. 24, 1986

[30] Foreign Application Priority Data

Jun. 29, 1985 [JP] Japan ..... 60-143587
Jun. 29, 1985 [JP] Japan ..... 60-143588

[51] Int. Cl.[4] ..... D05B 53/00
[52] U.S. Cl. ..... 112/286; 112/288; 112/302
[58] Field of Search ..... 112/162, 163, 165, 166, 112/164, 286, 288, 269.1, 302, 130, 235, 167, 177

[56] References Cited

U.S. PATENT DOCUMENTS 4,303,030 12/1981 Palacino et al. ..... 112/302 X
4,356,782 11/1982 Veyama et al. ..... 112/269.1 X
4,546,716 10/1985 Babson et al. ..... 112/162
4,644,884 2/1987 Tatsumi ..... 112/288 X

*Primary Examiner*—Peter Nerbun
*Attorney, Agent, or Firm*—Morgan & Finnegan

[57] ABSTRACT

In a two-needle overedge sewing machine, a thread chain guide recess is formed for positioning the thread chain at a given position on the throat plate so that the thread chain is spaced apart from the outer needle descending point. The thread chain guide recess may be made at a tip portion of an outer finger of the throat plate or at a tip portion of an outer finger of a presser foot. Furthermore, the thread chain guide recess may be formed by the combination of the outer finger of the throat plate and the outer finger of the presser foot. In an improved embodiment, a thread chain guide groove is formed in an upper surface of the outer finger of the throat plate so that the thread chain is substantially fully received therein.

6 Claims, No Drawings

APPARATUS FOR BACKTACKING THREAD CHAIN FOR USE WITH A TWO-NEEDLE OVEREDGE SEWING MACHINE

BACKGROUND OF THE INVENTION

1. Field of the Invention

This invention relates generally to a two-needle overedge sewing machine used for making stitches enwrapping the edge of a fabric material, and particularly to apparatus for backtacking a thread chain formed and cut after the last overedging work so that the thread chain is sewn into overedge stitches applied to a subsequent fabric material.

2. Description of Prior Art

Overedge seams formed by a two-needle overedger or an overedge (overlock) sewing machine used for enwrapping the edge of a fabric material, comprise needle threads, an upper looper thread and a lower looper thread. When a trailing edge of the fabric material is reached, then overedge sewing is terminated and the threads are woven to form a bar-shaped thread chain which extends over a desired length determined by the operating time and speed of the sewing machine. The fabric material is then turned around together with the thread chain extending from the trailing edge of the fabric material, to be brought to the operator's side with respect to the needles. The thread chain is stretched and is held by a clamp having a cutter to cut the thread chain. A portion of the thread chain extending from the clamp toward the needles is held on a throat plate, so that this portion of the thread chain will be sewn into overedge stitches applied to a subsequent fabric material subjected to overedging.

Generally speaking, such an overedger comprises two loopers as means for providing threads for forming enwrapping seams on a fabric material. During overedging, one looper, i.e. lower looper, moves from the position of a needle toward the edge of the fabric material in a direction normal to the line of seams below the material, while the other looper, i.e. upper looper, moves above the material from the edge thereof to intersect the passage of a needle. Such movement of the two loopers act to form overedge stitches, to enwrap the edge of the fabric material.

A two-needle overedger comprises two sewing needles arranged in parallel to each other. The throat plate used in such an overedger has an inner finger positioned between inner and outer needle descending points and an outer finger positioned beside the inner finger. The outer needle descending point is interposed between the inner and outer fingers which extend parallel to each other. One example of such a conventional two-needle overedge sewing machine is disclosed in U.S. Pat. No. 4,356,782.

When a thread chain is formed immediately after overedging work and the thread chain is pulled straight with the fabric turned around to be positioned at the operator's side to cut and clamp the thread chain, the remaining thread chain extending on the surface of the throat plate from the clamp-cutter is located close to the outer needle descending point. Therefore, when subsequent overedging work is started on another fabric material, the thread chain is pulled toward the needle as the needle descends. As a result, the thread chain is apt to be positioned at a position where the outer sewing needle descends. In such a case, the outer sewing needle penetrates the thread chain. Once the thread chain is sewn, enwrapping operation of the thread chain is interrupted and the greater part of the thread chain protrudes beyond the leading edge of the fabric material. In other words, the greater part of the thread chain remains unsewn without being backtacked. Furthermore, when the thread chain is in the above-mentioned state, the formation of loops by means of the upper looper is obstructed, since the loops are arranged to be formed on the upper surface of the fabric such that the upper looper moves so that the looper thread engages the needle thread.

As a result, some stitches formed by the overedge are skipped.

SUMMARY OF THE INVENTION

The present invention has been developed in order to remove the above-described drawbacks inherent in the conventional two-needle overedge sewing machine.

It is, therefore, an object of the present invention to provide a new and useful apparatus for sewing a thread chain into overedge loops so that the thread chain is not penetrated by an outer needle.

According to a feature of the present invention a thread chain guide means is employed for positioning the thread chain at a given position on the throat plate so that the thread chain is spaced apart from the outer needle descending point.

In accordance with the present invention there is provided apparatus for sewing a thread chain into overedge stitches for use with a two-needle overedge sewing machine, comprising: a clamp-cutter for clamping and cutting a thread chain after overedge sewing of a fabric material is finished so that a remaining thread chain is positioned on a throat plate of the overedge sewing machine; and means for guiding the thread chain so that the thread chain extends from the clamp-cutter in a sewing direction at a position spaced apart from a needle descending point of an outer needle used for stitching and fixing overedge thread which has just been sewn.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated by like reference numerals throughout the drawings.

DETAILED DESCRIPTION OF THE INVENTION

Prior to describing preferred embodiments of the present invention, the above-mentioned conventional arrangement will be described with reference to the drawings for a better understanding of the present invention.

Figure 1:
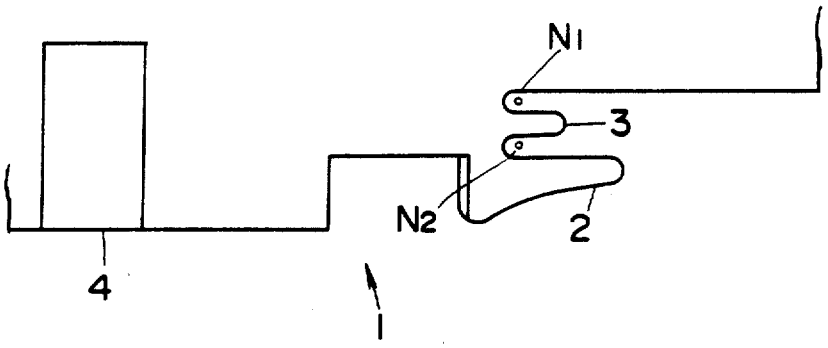
FIG. 1 (PRIOR ART)
FIG. 1 is a partial top plan view of a throat plate used in a conventional overedger.

FIG. 1 is a partial top plan view of a throat plate (also called a needle plate) used in a conventional overedger. The throat plate generally designated by reference numeral 1 comprises an outer finger or pawl 2 and an inner finger or pawl 3 which extend in parallel in a sewing direction. The references $N_1$ and $N_2$ designate inner and outer needles of a conventional two-needle overedge sewing machine. These references will also be used for indicating needle descending points which are located at both sides of the inner finger 3. A thread chain clamp 4 is mounted on the throat plate 2. This thread chain clamp 4 comprises a cutter or cutting blade (not shown) for cutting a thread chain, and thus this clamp 4 will be referred to as a clamp-cutter hereinafter.

Figure 2:
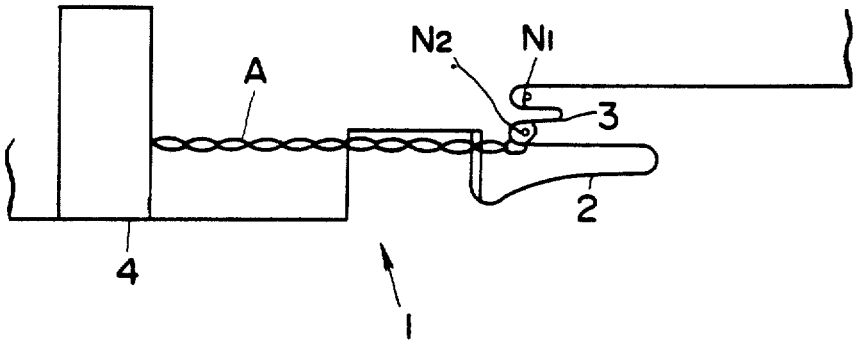
FIG. 2 (PRIOR ART)
FIG. 2 is a view showing the position of a thread chain on the throat plate of FIG. 1.

FIG. 2 shows a state in which a fabric material (not shown) has been sewn by the conventional overedger and the fabric is turned around the needle portion to be positioned at the operator's side to clamp and cut a thread chain A extending from a recess between the inner and outer fingers 2 and 3. After the thread chain A is cut, a portion of the thread chain A extending between the clamp-cutter 4 and the recess between the inner and outer fingers 2 and 3 lies close to a descending point of the outer needle $N_2$. Therefore, when subsequent overedge sewing is started with a new fabric material, the thread chain A is apt to be penetrated by the outer needle $N_2$ with the material being pulled as the needles $N_1$ and $N_2$ descend. As a result, aforementioned various problems occur.

Figure 3:
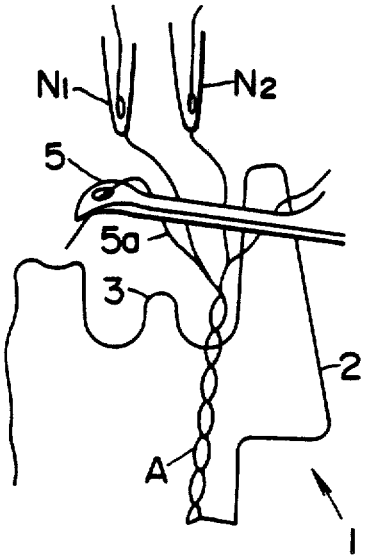
FIG.3 (PRIOR ART)
FIG. 3 is an explanatory diagram showing that an upper looper thread is pulled by the thread chain when the throat plate of FIG. 1 is used.

FIG. 3 shows a state in which an upper looper thread 5*a* passing through an eye of an upper looper 5 is pulled by the thread chain A to be positioned below the upper looper 5. More specifically, the upper looper thread 5*a*, which should form an arc above the upper looper 5 to engage a thread of the inner needle $N_1$, is pulled downward by the thread chain A penetrated by the outer needle $N_2$, and therefore, the arc is deformed. This makes it difficult for the thread of the inner needle $N_1$ to engage the upper looper thread 5*a*.

Figure 4:
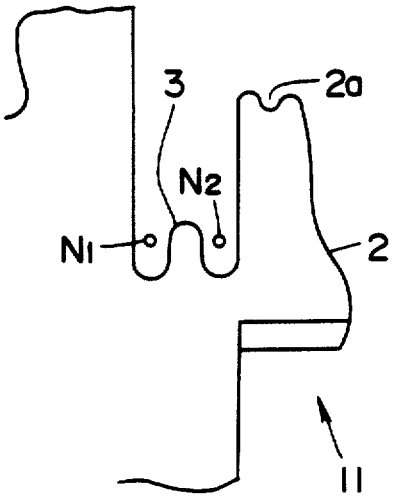
FIG. 4 is a schematic partial top plan view of a throat plate used in an embodiment of the present invention.

Referring now to FIG. 4, a top plan view is shown of a throat plate 11, in an embodiment of the present invention. The throat plate 11 of FIG. 4 comprises an outer finger or pawl 2 and an inner finger or pawl 3 arranged substantially parallel to each other in the same manner as in the conventional arrangement of FIG. 1. The throat plate 11 used in this embodiment differs from the conventional one in that a thread chain guide recess 2*a* is formed at a tip portion of the outer finger 2. While the thread chain guide recess 2*a* is semicircular in the illustrated embodiment, the shape of the recess 2*a* is not limited to this. In other words, any shape may be used for the thread chain guide recess 2*a* as long as the thread chain A is smoothly slidable therethrough.

The embodiment using the throat plate 11 shown in FIG. 4 operates as follows:

When overedging of a fabric material (not shown in the drawing) has been completed, the fabric is turned around the needles $N_1$ and $N_2$ to be brought to the operator's side with respect to the needles $N_1$ and $N_2$ by leading the thread chain A extending from the trailing edge of the fabric, to pass through the thread chain guide recess 2*a* of FIG. 4. The thread chain A is then pulled manually by the operator so that the stretched thread chain A is held and clamped by the clamp-cutter 4 with the thread chain A being led manually to be received in the thread chain guide recess 2*a*. The thread chain A is further pulled to be cut by a cutting blade (not shown) of the clamp-cutter 4. As a result, remaining portion of the thread chain A is left on the surface of the throat plate 11 to extend between the clamp-cutter 4 and the thread chain guide recess 2*a*.

Figure 5:
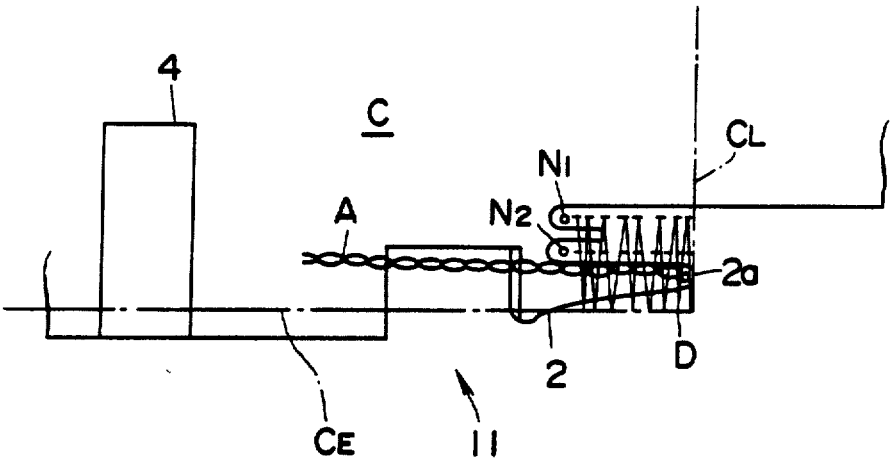
FIGS. 5 and 6 are views used for describing the operation of the embodiment of FIG. 4.

Subsequent overedging is now started with a new fabric material C shown by way of dot-dash line in FIG. 5. Overedge sewing is started from a leading edge $C_L$ of the fabric C. Since the thread chain A is positioned between the fabric C and the upper surface of the throat plate 11 such that its position is determined by the thread chain guide recess 2*a*, the thread chain A is effectively prevented from being penetrated by the outer needle $N_2$. In other words, the thread chain A is kept at a position spaced apart from the needle entry point of the outer needle $N_2$. In the illustrated embodiment, the position of the thread chain A corresponds to the center of the width of overedge stitches D which spread between the inner needle entry point and a side edge $C_E$ of the fabric C. Since the thread chain A is held at such a position, the thread chain A is sewn into the overedging thread, i.e. a lower looper thread, such that the thread chain A is fixedly held by the overedging thread. More specifically, the thread chain A is interposed between a lower surface of the fabric C and the overedge thread located below the fabric C such that the overedge thread does not pass through or penetrate the thread chain A.

Furthermore, since the thread chain A extends between the clamp-cutter 4 and the thread chain guide recess 2*a* as described in the above, unnecessary force is not applied to the threads located ahead the thread chain guide recess 2*a*. As a result, the upper looper thread 5*a* forms an arc B at a correct position, i.e. above the upper looper 5, and therefore, the needles $N_1$ and $N_2$ accurately engage the loop formed by the arc B. Thus, the problem of skipped stitches which is apt to occur in conventional arrangements does not occur.

Figure 7:
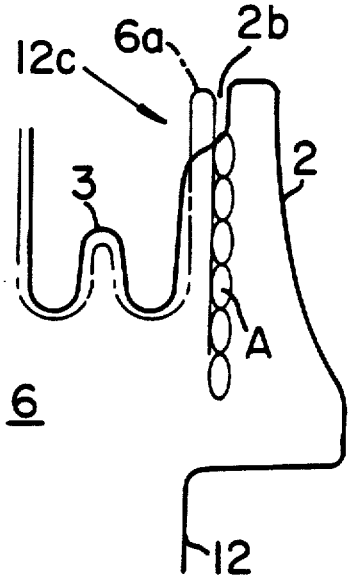
FIG. 7 shows another embodiment of the present invention.

FIG. 7 shows another embodiment of the present invention. In this embodiment, although no guide recess is formed at the tip portion of the outer finger 2 of the throat plate, which is now designated by the reference numeral 12, the tip portion of the outer finger 2 is made narrow by providing a cut-out 12*c* at an inner side of the tip portion. The reference numeral 6 indicates a pressor foot which is used for pressing a fabric to be sewn. The pressor foot 6 comprises an outer finger 6*a* whose tip portion is located above the cut-out 12*c*. As a result, a generally U-shaped guide recess 2*b* is formed by an outer edge of the outer finger 6*a* of the presser foot 6 and the inner edge of the outer finger 2 of the throat plate 12. Thus the guide recess 2*b* is used in the same manner as the guide recess 2*a* of FIG. 4.

Figure 8:
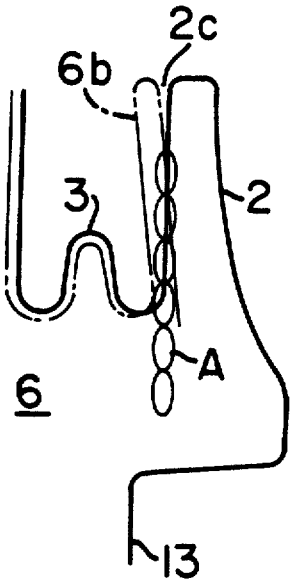
FIG. 8 shows a modification of the embodiment of FIG. 7.

FIG. 8 shows a modification of the above-mentioned embodiment of FIG. 7. More specifically, while no cut-out is provided to the tip portion of the outer finger 2 of the throat plate, which is now designated by a reference numeral 13, an outer finger 6*b* of the presser foot 6 is arranged to be inclined with respect to the inner edge of the outer finger 2 of the throat plate 13 so that a generally V-shaped guide recess 2*c* is formed by an outer edge of the outer finger 6*a* of the presser foot 6 and the inner edge of the outer finger 2 of the throat plate 13. Thus the guide recess 2*c* is used in the same manner as the guide recess 2*a* of FIG. 4 or the guide recess 2*b* of FIG. 7.

Figure 9:
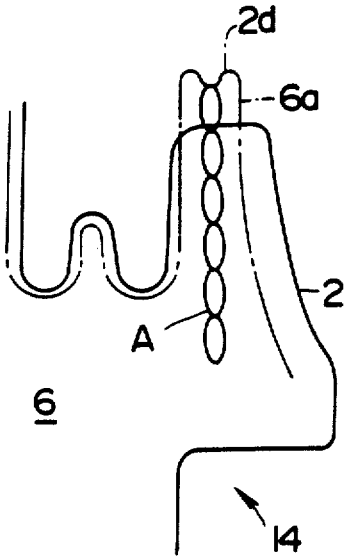
FIG. 9 shows another embodiment of the present invention.

FIG. 9 shows another embodiment using only a presser foot 6 for providing a thread chain guide recess 2*d*. More specifically, the thread chain guide recess 2*d* is formed at a tip portion of an outer finger 6*a* of the presser foot 6 while the outer finger 2 of a throat plate 14 used in this embodiment is made shorter than that of the same in the previous embodiments. The shape of outer finger 6*a* of the presser foot 6 as well as the position of the thread chain guide recess 2*d* is selected such that the thread chain A to be interposed between the thread chain guide recess 2*d* and the clamp-cutter 4 is positioned at a desired position. The clamp-cutter 4 is mounted on the upper surface of the throat plate 14 in the same manner as in FIG. 4. The thread chain guide recess 2*d* in this embodiment is also used in the same manner as that in the previous embodiments.

Figure 10:
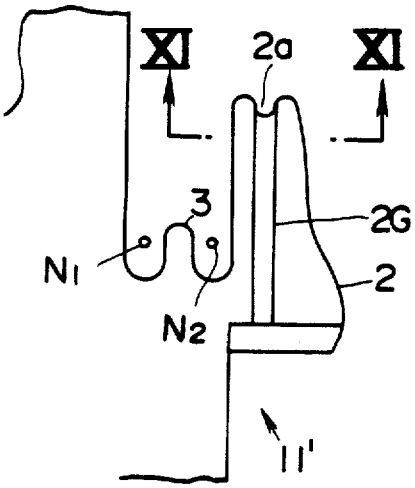
FIG. 10 is a schematic partial top plan view of a throat plate used in a further embodiment of the present invention.
Figure 11:
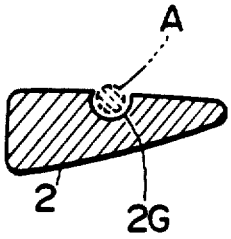
FIG. 11 is a cross-sectional view taken along a line XI—XI in FIG. 10.

Reference is now made to FIGS. 10 and 11 showing an improved embodiment of the present invention. This embodiment is an improvement of a previous embodiment illustrated in FIG. 4, and differs from FIG. 4 in that a thread chain guide groove 2G is additionally provided. The thread chain guide groove 2G is made in the surface of the outer finger 2 of a throat plate 11′ to extend from the thread chain guide recess 2*a* toward the clamp-cutter 2 (see FIG. 12). As seen in a cross-sectional view shown in FIG. 11, the guide groove 2G has a semicircular cross-section in the illustrated embodiment. However, any cross-sectional shape may be used as long as the depth of the guide groove 2G is selected so that the thread chain A is substantially embedded or substantially fully received therein.

Figure 6:
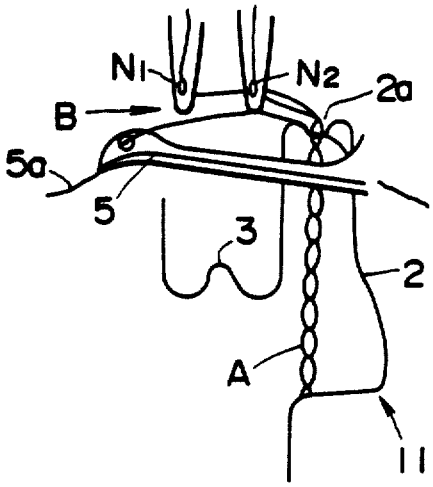
Figure 12:
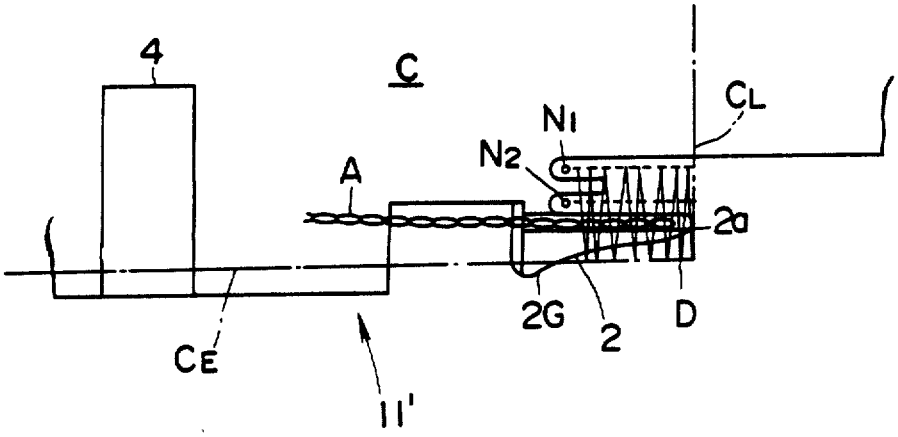
FIGS. 12 and 13 are views used for describing the operation of the embodiment of FIG. 10.
Figure 13:
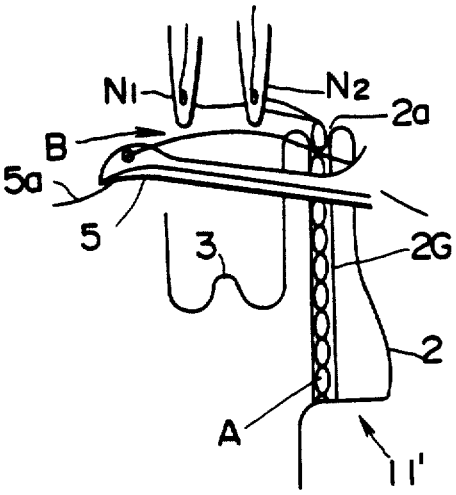

The operation of the embodiment using the throat plate 11′ shown in FIGS. 10 and 11 will be described with reference to FIGS. 12 and 13 hereinbelow. When overedging of a fabric material (not shown) has been completed, the fabric is turned around in the same manner as described in connection with a first embodiment of FIG. 4, and the thread chain A extending from the trailing edge of the material above the outer finger 2 is led manually to be received in the thread chain guide recess 2*a* and the thread chain guide groove 2G. The thread chain A is pulled manually by the operator so that the stretched thread chain A is held and clamped by the clamp-cutter 4, and is further pulled to be cut by a cutting blade of the clamp-cutter 4. After the thread chain A is cut in this way, the remaining portion of the thread chain A is left on the throat plate 11′ such that it is received in the thread chain guide groove 2G as shown in FIGS. 5 and 6 extending between the clamp-cutter 4 and the thread chain guide recess 2*a*.

Subsequent overedging is then started with a new fabric material C from a leading edge $C_L$ of the fabric C. Since the thread chain A is positioned between the fabric C and the upper surface of the throat plate 11 such that the thread chain A is substantially embedded in the guide groove 2G and the position of the thread chain A is determined by the thread chain guide recess 2*a* and also by the thread chain guide groove 2G, the thread chain A is effectively prevented from being penetrated by the outer needle $N_2$.

In addition, since the thread chain A is substantially embedded in the guide groove 2G, as best seen in FIG. 11, when a loop-like thread chain is formed around the outer finger 2 prior to subsequent overedging, the bar-shaped thread chain A interposed between the fabric C and the outer finger 2 is not affected by a tightning force from the loop-like thread chain formed around the outer finger 2. This point will be further described with reference to FIGS. 14 and 15.

Figure 14:
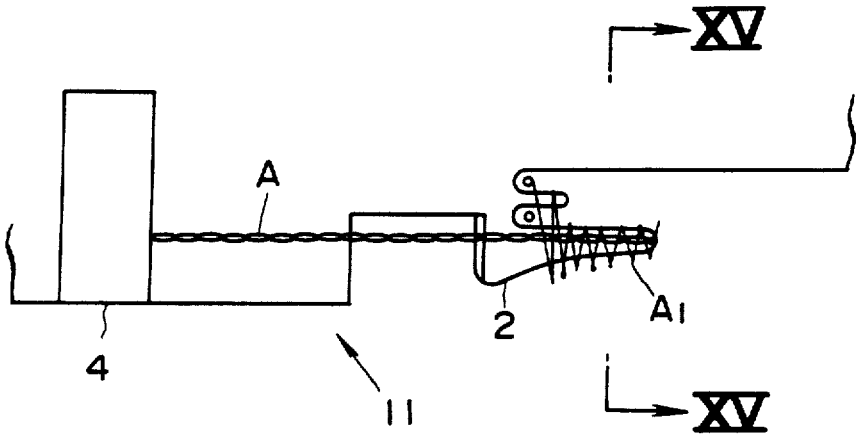
FIG. 14 is a view showing how new thread chain is formed when the throat plate of FIG. 4 is used.

FIG. 14 shows how the above-mentioned loop-like thread chain is formed. In the case that the outer finger 2 of the throat plate 11 does not have a groove as in the embodiment of FIG. 4, the bar-shaped thread chain A is wrapped by the loop-like thread chain $A_1$ formed around the outer finger 2 at the beginning of overedging work. Since the bar-shaped thread chain A is generally cylindrical, and since the tightening force exerted by the loop-like thread chain $A_1$ is very large, the bar-like thread chain A is pulled to the right in FIG. 14. Therefore, it is necessary that the clamp-cutter 4 has a considerable supporting force which is comparable to the pulling force, in order that a bar-shaped thread chain is continuously formed in succession to the already formed bar-shaped thread chain A. However, the increase in the clamping or supporting force by the clamp-cutter 4 may result in undesirable pulling of a leading edge portion of a fabric material at the beginning of overedge sewing. When such an undesirable pulling force is applied to the fabric, the fabric is apt to be deformed.

Figure 15:
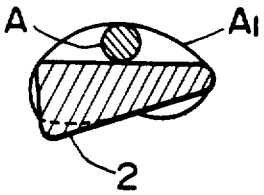
FIG. 15 is a cross-sectional view taken along a line XV—XV in FIG. 14.

On the contrary, according to the embodiment of FIGS. 10–13, since the bar-shaped thread chain A is substantially fully received in the guide groove 2G, the length of a loop of a loop-like thread formed around the outer finger 2 is shorter than that in FIG. 15. Thus, the bar-shaped thread chain A is not subjected to unnecessary tightening force from the loop-like thread chain $A_1$. As a result, it is unnecessary to increase the clamping force of the clamp-cutter 4, and thus the problem of deformation of the fabric C does not occur in this embodiment.

As described in the above, according to the present invention the thread chain is securely held and positioned accurately so that the thread chain is not penetrated by the outer needle and thus the thread chain is sewn into the overedge thread over a predetermined distance from a leading edge of a fabric material to be overedge sewn.

The above-described embodiments are just examples of the present invention, and therefore, it will be apparent for those skilled in the art that many modifications and variations may be made without departing from the scope of the present invention.

What is claimed is:

1. Apparatus for sewing a thread chain into overedge stitches for use with a two-needle overedge sewing machine, comprising:

(a) a clamp-cutter for clamping and cutting a thread chain after overedge sewing of a fabric material is finished so that a remaining thread chain is positioned on a throat plate of said overedge sewing machine; and (b) means for guiding said thread chain so that said thread chain extends from said clamp-cutter in a sewing direction at a position spaced apart from a needle descending point of an outer needle used for stitching and fixing overedge thread which has just been sewn; and wherein said means is a recess formed at a tip portion of an outer finger of a throat plate.

2. Apparatus for sewing a thread chain into overedge stitches for use with a two-needle overedge sewing machine, comprising:

(a) a clamp-cutter for clamping and cutting a thread chain after overedge sewing of a fabric material is finished so that a remaining thread chain is positioned on a throat plate of said overedge sewing machine; and (b) means for guiding said thread chain so that said thread chain extends from said clamp-cutter in a sewing direction at a position spaced apart from a needle descending point of an outer needle used for stitching and fixing overedge thread which has just been sewn; and wherein said means is a recess formed between an outer finger of a presser foot and an outer finger of a throat plate where a cut-out is provided around a tip portion of said outer finger of said throat plate so that said recess is generally U-shaped.

3. Apparatus for sewing a thread chain into overedge stitches for use with a two-needle overedge sewing machine, comprising:

(a) a clamp-cutter for clamping and cutting a thread chain after overedge sewing of a fabric material is finished so that at remaining thread chain is positioned on a throat plate of said overedge sewing machine; and (b) means for guiding said thread chain so that said thread chain extends from said clamp-cutter in a sewing direction at a position spaced apart from a needle descending point of an outer needle used for stitching and fixing overedge thread which has just been sewn; and wherein said means is a recess formed between an outer finger of a presser foot and an outer finger of a throat plate where said outer finger of said presser foot is inclined with respect to said outer finger of said throat plate so that said recess is generally V-shaped.

4. Apparatus for sewing a thread chain into overedge stitches for use with a two-needle overedge sewing machine, comprising:

(a) a clamp-cutter for clamping and cutting a thread chain after overedge sewing of a fabric material is finished so that a remaining thread chain is positioned on a throat plate of said overedge sewing machine; and (b) means for guiding said thread chain so that said thread chain extends from said clamp-cutter in a sewing direction at a position spaced apart from a needle descending point of an outer needle used for stitching and fixing overedge thread which has just been sewn; and wherein said means is a recess formed at a tip portion of an outer finger of a presser foot, a throat plate associated with said presser foot having an outer finger of a short length so that said tip portion of said outer finger of said presser foot protrudes beyond the tip portion of said outer finger of said throat plate.

5. Apparatus as claimed in claim 1, further comprising a guide groove formed in an upper surface of said outer finger, said guide groove extending in a sewing direction over substantially the entire length of said outer finger.

6. Apparatus as claimed in claim 5, wherein said guide groove has a depth which is such that said thread chain is substantially fully received therein.

* * * * *

UNITED STATES PATENT AND TRADEMARK OFFICE

CERTIFICATE OF CORRECTION

PATENT NO. : 4,774,900

DATED : October 4, 1988

INVENTOR(S) : Kikuo Aida et al.

It is certified that error appears in the above-identified patent and that said Letters Patent is hereby corrected as shown below:

The title page should be deleted to appear as per attached title page.

The attached sheets of drawing consisting of Figures 1---15 should be added as per attached sheets.

On the title page, "6 Claims, No Drawings" should read

-- 6 Claims 15 Drawing Figures --.

Signed and Sealed this

Fourteenth Day of March, 1989

*Attest:*

*Attesting Officer*

DONALD J. QUIGG

*Commissioner of Patents and Trademarks*

United States Patent [19]

Aida et al.

[11] Patent Number: 4,774,900

[45] Date of Patent: Oct. 4, 1988

[54] APPARATUS FOR BACKTACKING THREAD CHAIN FOR USE WITH A TWO-NEEDLE OVEREDGE SEWING MACHINE

[75] Inventors: Kikuo Aida; Shingo Iwae, both of Chofu, Japan

[73] Assignee: Tokyo Juki Industrial Co., Ltd., Tokyo, Japan

[21] Appl. No.: 878,000

[22] Filed: Jun. 24, 1986

[30] Foreign Application Priority Data

Jun. 29, 1985 [JP] Japan ..... 60-143587
Jun. 29, 1985 [JP] Japan ..... 60-143588

[51] Int. Cl.[4] ..... D05B 53/00

[52] U.S. Cl. ..... 112/286; 112/288; 112/302

[58] Field of Search ..... 112/162, 163, 165, 166, 112/164, 286, 288, 269.1, 302, 130, 235, 167, 177

[56] References Cited

U.S. PATENT DOCUMENTS 4,303,030 12/1981 Palacino et al. ..... 112/302 X
4,356,782 11/1982 Veyama et al. ..... 112/269.1 X
4,546,716 10/1985 Babson et al. ..... 112/162
4,644,884 2/1987 Tatsumi ..... 112/288 X

*Primary Examiner*—Peter Nerbun
*Attorney, Agent, or Firm*—Morgan & Finnegan

[57] ABSTRACT

In a two-needle overedge sewing machine, a thread chain guide recess is formed for positioning the thread chain at a given position on the throat plate so that the thread chain is spaced apart from the outer needle descending point. The thread chain guide recess may be made at a tip portion of an outer finger of the throat plate or at a tip portion of an outer finger of a presser foot. Furthermore, the thread chain guide recess may be formed by the combination of the outer finger of the throat plate and the outer finger of the presser foot. In an improved embodiment, a thread chain guide groove is formed in an upper surface of the outer finger of the throat plate so that the thread chain is substantially fully received therein.

6 Claims, No Drawings

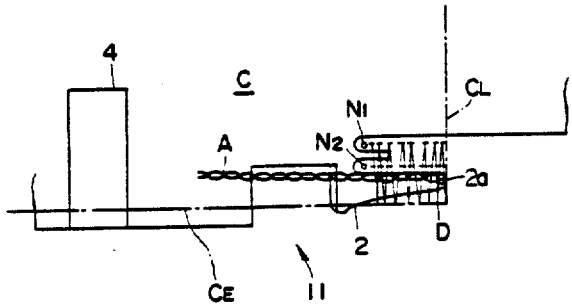

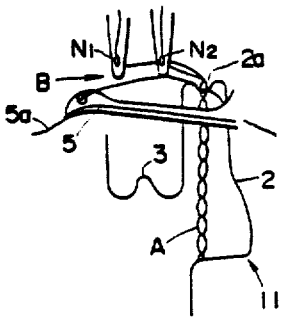

Patent No. 4,774,900 October 4, 1988

Kikuo Aida et al.

Patent No. 4,774,900 October 4, 1988

Kikuo Aida et al.

Patent No. 4,774,900 October 4, 1988

Kikuo Aida et al.

Kikuo Aida et al.

Patent No. 4,774,900

October 4, 1988

Kikuo Aida et al.